US006431778B1

(12) United States Patent
Coudray et al.

(10) Patent No.: US 6,431,778 B1
(45) Date of Patent: Aug. 13, 2002

(54) DEVICE FOR SYMBOL PRINTING AND FRANKING MACHINE COMPRISING SAME

(75) Inventors: Gérard Coudray, Andresy; Jacques Beord, Conches; Hervé Baumann, Paris, all of (FR)

(73) Assignees: SECAP, Boulogne-Billancourt (FR); Ascom Hasler Mailing Systems AG, Bern (CH)

( * ) Notice: Subject to any disclaimer, the term of this patent is extended or adjusted under 35 U.S.C. 154(b) by 0 days.

(21) Appl. No.: 09/700,490

(22) PCT Filed: Mar. 15, 2000

(86) PCT No.: PCT/FR00/00624

§ 371 (c)(1),
(2), (4) Date: Nov. 16, 2000

(87) PCT Pub. No.: WO00/54976

PCT Pub. Date: Sep. 21, 2000

(30) Foreign Application Priority Data

Mar. 16, 1999 (FR) ..... 99 03253

(51) Int. Cl.[7] ..... B41J 13/08; B41J 13/12; B41J 13/30

(52) U.S. Cl. ..... 400/635; 400/56; 271/275

(58) Field of Search ..... 400/635, 56; 271/34, 271/35, 10.15, 4.06, 7, 10.1, 275; 705/406, 408

(56) References Cited

U.S. PATENT DOCUMENTS

| | | | | |
|---|---|---|---|---|
| 4,361,086 A | * | 11/1982 | Simonotti et al. | 101/93.18 |
| 4,821,049 A | * | 4/1989 | Eckl | 346/134 |
| 5,467,973 A | * | 11/1995 | Graushar et al. | 270/1.1 |
| 5,685,657 A | | 11/1997 | Jablonski | 400/635 |
| 5,806,994 A | | 9/1998 | Coffy et al. | 400/120.01 |

FOREIGN PATENT DOCUMENTS

FR 2766757 A1 * 2/1999

* cited by examiner

*Primary Examiner*—Daniel J. Colilla
(74) *Attorney, Agent, or Firm*—Crowell & Moring LLP

(57) ABSTRACT

The invention concerns a device comprising a belt with one side opposite unsprung support means and extending between an upstream roller and a downstream roller both suspended so that the object can be sandwiched between the unsprung support means and said belt side, the latter being wound around at least two other rollers whereof at least one is unsprung.

20 Claims, 3 Drawing Sheets

DEVICE FOR SYMBOL PRINTING AND FRANKING MACHINE COMPRISING SAME

BACKGROUND AND SUMMARY OF THE INVENTION

The invention relates to a device for printing a sign at a predetermined location on one face of a flat object having a thickness lying within a given range.

It is known that this type of device is found especially in franking machines, the sign to be printed being the franking mark.

It has already been proposed, especially in the French patent application 97 09888 (2 766 757), to provide an abutment element for the face of the object to be printed, to move the object with its face to be printed which is flush with this element, and to deposit the sign to be printed while the object is moving, by virtue of an ink jet cartridge which can be used since the abutment element makes it possible to keep constant the distance between the ink spray nozzle and the location of the object where the sign is to be printed, despite the variations in thickness from one object to another as well as the disparities in thickness which the same object may exhibit.

The invention aims to furnish such a device featuring good performance as far as print quality is concerned.

To that end it proposes a device for printing a sign at a predetermined location on one face of a flat object having a thickness lying within a given range, including an abutment element for the face of the flat object to be printed, drive means for moving the object along the abutment element with its face to be printed which is flush with this element, and printing means including means for depositing the said sign at the said predetermined location while the object is moved by the drive means along the abutment element, the said drive means including a non-suspended support means for the face of the said object to be printed, and including a belt featuring a stretch facing the said support means and extending between an upstream roller and a downstream roller which are suspended in such a way that the said object can be sandwiched between the said non-suspended support means and the said stretch of the belt; characterized in that the said belt is wound around at least two other rollers, at least one of which is not suspended.

The presence of these other rollers is favorable for maintaining tension in the belt and thus for the constancy of the speed of movement of the stretch in contact with the object, which makes it possible to obtain good regularity for the printing of the sign.

According to preferred characteristics, at least one of the rollers around which the said belt is wound is driven in rotation.

The belt is thus put into movement by one of the rollers about which it is wound, which is favorable to the constancy of its speed and thus to the regularity of the printing of the sign.

In particular, the regularity of the speed is better than in the device described by the abovementioned patent application, in which the belt is driven by external counter-rollers on which the upstream roller and the downstream roller respectively bear, the conditions of contact between the belt and these rollers being altered during suspension movements of the upstream and downstream rollers.

For reasons of production convenience, it is the said other, non-suspended roller which is preferably driven in rotation.

According to other preferred characteristics, the device according to the invention includes an arm carrying the journal of one of the said upstream rollers and downstream roller while the said arm is mounted so as to oscillate on the journal of the said other non-suspended roller.

The guidance of the suspension movement of the upstream roller and/or of the downstream roller obtained by virtue of this arm in effect makes it possible to obtain good maintenance of the tension of the belt.

The said arm preferably extends downstream from the said journal on which it is mounted so as to oscillate.

According to other preferred characteristics, for the reasons which have just been set out, each of the said other two rollers is not suspended and each of the said upstream roller and downstream roller is carried by a respective arm mounted so that it can oscillate on the journal of a respective one of the said other two rollers.

According to other preferred characteristics, the said belt is wound around three other said rollers, respectively a first non-suspended roller, a second non-suspended roller and a third suspended roller.

The presence of this third other roller makes it possible to obtain particularly good regularity of the speed of movement of the belt.

The said third suspended roller is preferably suspended dependently from one of the said upstream rollers and downstream roller, such that, if this latter has a suspension movement of such a nature as to slacken the said belt, the suspension movement of the third roller is of such a nature as to re-tension the said belt.

Also preferably, for practical reasons of size, the said third roller is suspended dependently from the said downstream roller.

According to other preferred characteristics, the device according to the invention includes an arm mounted so that it can oscillate at its center on the journal of the said other non-suspended roller, the said arm carrying, at one end, the journal of one of the said upstream roller and downstream roller, while at the other end it carries the journal of a said second other roller.

Hence, any slack due to the suspension movement of the upstream or downstream roller is taken up by the second other roller, the angle of winding of the belt on this second other roller is preserved at least approximately during suspension movements, which is particularly beneficial when the second other roller is driven and, which is also particularly beneficial in this case, the second other roller is in contact with the belt via the face thereof which is intended to come into contact with the object, in such a way that advantage is taken, for driving the belt, of any anti-slip character of this face.

According to other preferred characteristics, the said non-suspended support means is formed by the stretch of a second belt extending between two non-suspended rollers, positioned in a predetermined way with respect to the said abutment element.

By virtue of these characteristics it is possible to obtain excellent printing results, especially if the two belts are driven synchronously at the same speed.

According to other preferred characteristics:

- the said second belt is wound exclusively around non-suspended rollers;
- two of the said non-suspended rollers around which the said second belt is wound serve as a counter-roller respectively for the said upstream roller and for the said downstream roller;
- the same motor serves to drive the said belt and second belt;

the said abutment element is offset laterally with respect to the said support means;

the said abutment element is arranged between the said support means and a lateral abutment means for the said object to be franked; and/or the said printing means include at least one ink jet cartridge equipped with a head for sending ink onto the said predetermined location of the object, from a recess in the abutment element.

According to a second aspect, the invention also envisages a franking machine including a device as set out above, for printing a franking mark.

BRIEF DESCRIPTION OF THE DRAWINGS

The explanation of the invention will now continue with a description of an embodiment, given below in an illustrative and non-limiting way, by reference to the attached drawings. On these.

Figure 1:
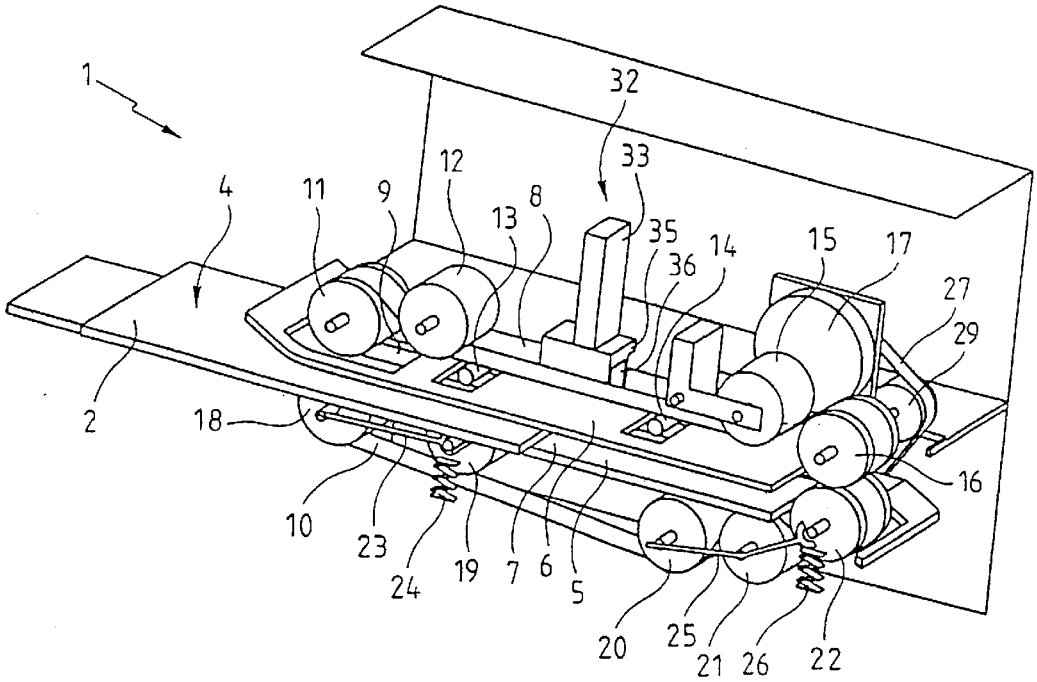
FIG. 1 is a very diagrammatic view in perspective of a device in accordance with the invention, forming part of a franking machine, a letter being shown as it passes through this machine.

The franking machine 1 illustrated in the drawing includes a device for printing a franking mark onto a flat object such as the letter 2, at the standardized location 3 (FIG. 2) located on the face on which can be read the address of the intended recipient, here the upper face 4 of the envelope which the letter 2 includes.

In order to print the franking mark at the location 3, it is necessary to pass the letter 2 through a corridor 5 which the machine 1 includes, this corridor being bounded by elements integral with the frame, respectively a support 6 which forms the roof of the corridor 5, a table 7 which forms the floor thereof and a rim 8 which forms a lateral limit thereof, the corridor being open on the opposite side to the rim 8.

In order to pass the letter 2 through the corridor 5, the letter is placed on that part of the table 7 which is projecting on the side intended for insertion (the side which is seen on the left in the drawings), until it is driven along by the means provided for this purpose in the machine 1, the printing of the franking mark taking place automatically while the letter 2 is driven along the corridor 5, the franked letter being ejected from the machine at the other end of the corridor 5 (the end which can be seen to the right on the drawings).

Figure 5:
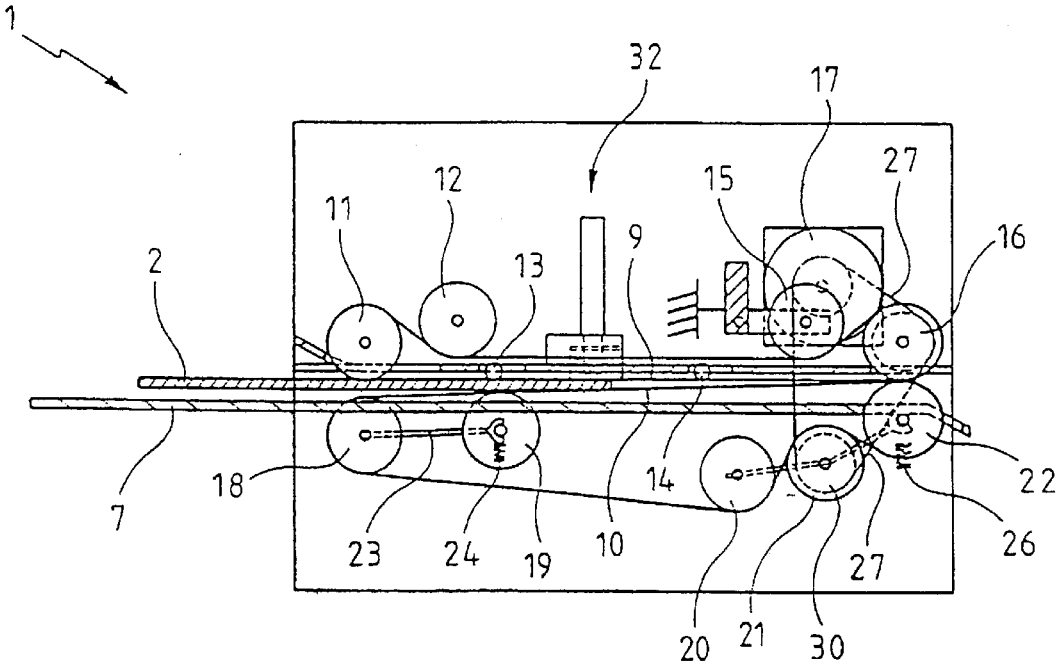

In order to drive the objects such as the letter 2, the machine 1 includes an upper belt 9 and a lower belt 10 so as to catch them in a sandwich, as shown in FIGS. 1 and 5.

The upper belt 9 turns around six rollers 11 to 16 mounted so as to rotate on the frame of the machine, without being suspended with respect to it, the rollers 11 and 16 delimiting the extremities, respectively upstream and downstream, of the loop which the belt 9 forms, the lower portion of this loop being situated in the corridor 5 and resting on the rollers 13 and 14, which are of small dimensions, the upper portion of this loop being situated above the support 6 and encountering the rollers 12 and 15 which divert the belt 9 so as to make it loop round close to the support 6, the position of the roller 15 being adjustable by virtue of a pressure screw (not represented) so as to impart to the belt 9 the tension required to avoid it slipping with respect to the roller 16, which serves to drive it in rotation, the roller 16 itself being driven by virtue of the motor 17, as will be explained below.

The lower belt 10 turns around five rollers 18 to 22 among which the rollers 18 and 21 are mounted so as to rotate on the frame of the machine 1 without being suspended with respect to it, while the rollers 19, 20 and 22 are suspended, the rollers 18 and 22 delimiting the extremities, respectively upstream and down-stream, of the loop which the belt 10 forms, the upper portion of this loop being situated in the corridor 5 where it rests on the rollers 18, 19 and 22, while the lower portion of this loop is situated below the table 7 where it encounters, between the rollers 22 and 18, the rollers 21 and 20, the roller 21 serving to drive the belt 10 in rotation, and itself being driven, as will be explained below, by virtue of the motor 17.

In order to allow the roller 19 to have a suspension movement, its central journal is carried by an arm 23 mounted so as to oscillate on the journal of the roller 18, so that the journal of the roller 19 can describe a circular-arc trajectory with respect to the journal of the roller 18, a spring 24 being provided to force the arm 23 upwards, that is to say in the direction which forces the roller 19 towards the stretch of the upper belt 9 located in the corridor 5.

It will be observed that the roller 18 is arranged just below the roller 11, spaced away from it, and that the relative arrangement of the rollers 13 and 19 is such that the roller 13 serves as a counter roller for the roller 19, providing it with a seating taking up the forces exerted by the spring 24.

In order to allow the suspension movements of the rollers 20 and 22, the journal of each of these rollers is mounted at one respective end of an arm 25 the center of which is mounted so as to oscillate on the journal of the roller 21, the path followed by the journal of the rollers 20 and 22 upon a suspension movement thus being a circular arc centered on the journal of the roller 21, the movements of the rollers 20 and 22 being in opposition, that is to say that when the roller 22 is lowered, the roller 20 is raised and vice versa.

A spring 26 is provided to force the arm 25 in the direction in which the roller 22 is raised, that is to say in the direction where it comes up against the stretch of the upper belt 9 located in the corridor 5.

It will be observed that the roller 16 serves as a counter roller for the roller 22, that is to say that it allows it to take up the forces exerted by the spring 26.

Thus, as indicated above, the motor 17 serves to drive the rollers 16 and 21 in rotation, which is achieved by virtue of a belt 27 (not represented in FIG. 4) engaged on the pulley 28 of the motor 17, on the pulley 29 integral with the journal of the roller 16 and on the pulley 30 integral with the journal of the roller 21.

It will the seen that by having the motor 17 turn in an anti-clockwise direction (as can be seen on the drawings), the rollers 16 and 21 turn in that direction, so that the portion of each of the belts 9 and 10 located in the corridor 5 is moved from left to right, that is to say from the end where the object 2 is inserted towards the exit end, the linear speed of the belts 9 and 10 being exactly the same, the pulleys 29 having the same diameter, and likewise for the rollers 16 and 21.

Figure 2:
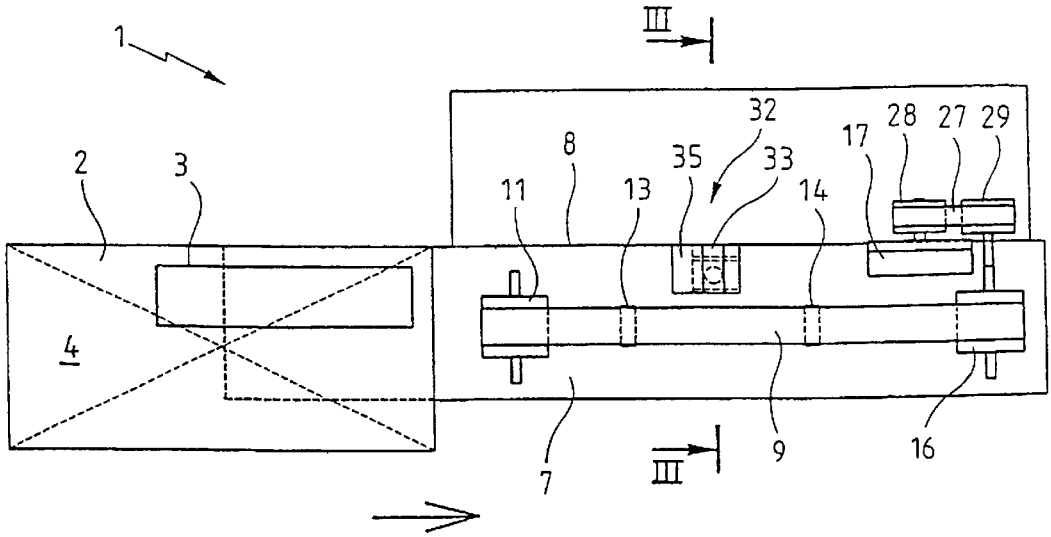
FIG. 2 is a top view of this device in which, for clarity in the drawing, only certain elements thereof have been represented, a letter to be franked being shown being inserted into the machine.
Figure 4:
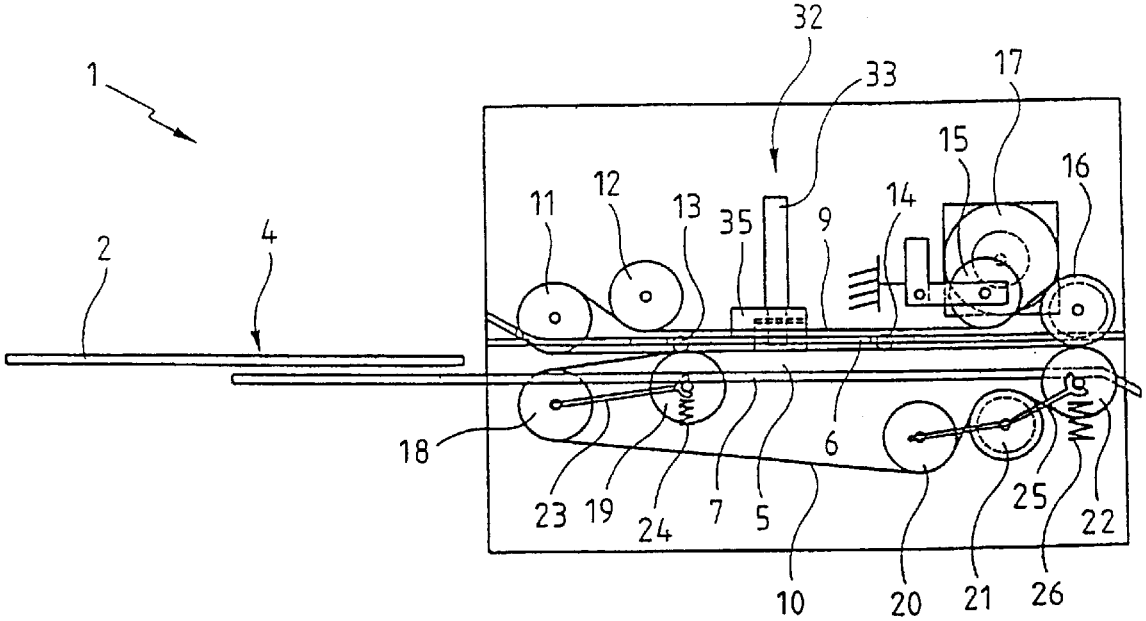
FIGS. 4 and 5 are side views of the device, respectively with a letter being inserted and a letter passing through, as in FIGS. 2 and 1.

The letter 2, when it is inserted into the machine 1 as shown in FIGS. 2 and 4, ends up encountering the belts 9 and 10 between which it can be inserted by virtue of the lowering of the roller 19 counter to the spring 24, the letter 2 finally being sandwiched between the belts 9 and 10, as shown in FIG. 5, the lowering of the roller 22 allowing the letter 2 to continue on its way and to exit from the machine 1.

It will be noted that the suspension movements performed by the rollers 19 and 22 in order to allow the letter 2 to pass, as well as the movement of the roller 20 which results therefrom, are such that the belt 10 does not develop any slack, and that, in consequence, it remains well pressed against the roller 21, which therefore does not skid with respect to the belt 10, which allows the latter to have a movement remaining synchronous with respect to that of the belt 9.

The upper and lower faces of the letter 2 are thus driven along at exactly the same speed, which avoids giving rise to folds or ripples on these surfaces which might be prejudicial to the quality of the printing of the franking mark performed, in the way explained below, while the letter 2 passes through the machine 1.

It will be observed, moreover, that the fact of making the belt 10 turn around the roller 21 while making it change direction of curvature, that is to say by putting the belt 10 in contact with the roller 21 via its face opposite to that by which it is in contact with the rollers 20 and 22, makes it possible to have the belt 10 wound around the roller 21 over a relatively large angle, and also to make this roller cooperate with this belt via the face thereof which is intended for driving the letter 2, that is to say with its face which is intended not to be slippery, so that the risks of the roller 21 slipping with respect to the belt 10 are reduced to the minimum.

Figure 6:
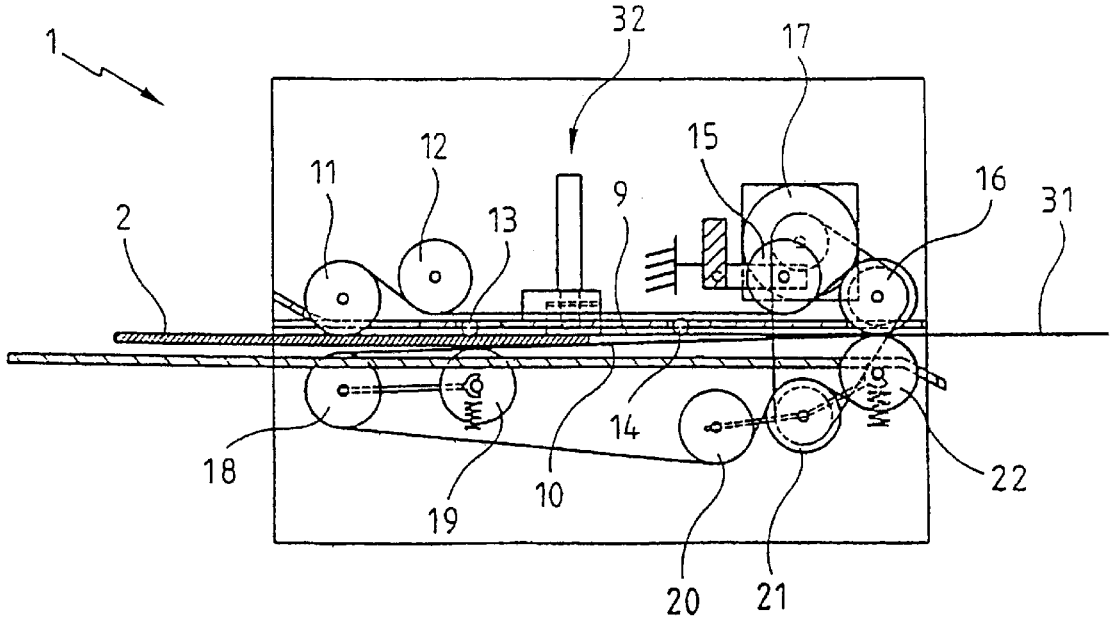
FIG. 6 is a view similar to FIG. 5, but showing the letter passing through the machine just behind a franking label.

By virtue of the independence of the suspensions of the roller 19 and roller 22, the difference in thickness existing between two objects which succeed each other, for example the franking label 31 and the letter 2 which are shown in FIG. 6, makes it possible to be certain that each of the objects present in the corridor 5 is firmly sandwiched between the belts 9 and 10, and thus driven correctly (if there were any dependency between the suspension of the rollers 19 and 22, the thinner object would run the risk of not being pinched sufficiently hard between the belts, and would be subject to a different drive force on its lower and upper faces, which is likely to cause folds and ripples on the surface to be printed).

More generally, it will be observed that the corridor 5 and the drive means of the machine 1 are capable of admitting objects the maximum thickness of which corresponds to the spacing between the rollers 11 and 18, and that whatever the thickness of the object driven, or the disparity in thickness which it may exhibit, its face to be printed will be very precisely pressed against the outer surface of the belt 9 at least between the rollers 13 and 14.

In order to print the franking mark at the location 3, the machine 1 includes printing means 32 mounted directly on the frame of the machine, situated transversely between the rim 8 and the belts 9 and 10 and situated, in the longitudinal direction, between the rollers 13 and 14.

More precisely, the printing means 32 include an ink jet cartridge 33 equipped with a print head 34 (FIG. 3) passing through an aperture in a mechanism plate 35 which features a recess 36 from which the head 34 can send the ink onto the object 2, without coming into contact with it.

In order to prevent the ink which has just been applied by the head 34 streaking or running, the recess 36 is open downstream of the head 21, as can be seen in FIG. 1.

Figure 3:
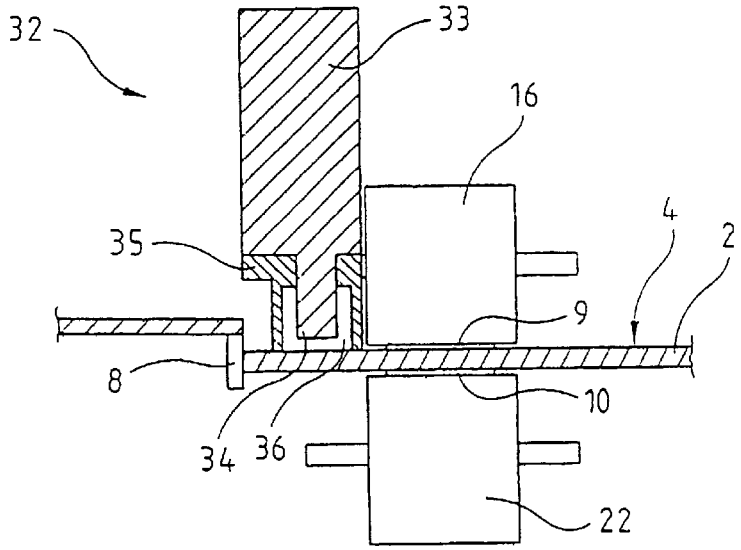
FIG. 3 is a sectional side view taken as indicated by III—III in FIG. 2, the letter to be franked passing through the machine with a portion in the region of the printing means.

It will be observed, as shown in FIG. 3, that the means for driving the object 2 move it in such a way that its face to be printed 4 is flush with the mechanism plate 35 and that it serves as an abutment element preventing the face 4 encountering the head 34, the positioning of the face 4 with respect to the mechanism plate 35 being more precisely obtained by the portion of the belt 9 situated between the rollers 13 and 14.

In order for the printing means 32 to be controlled in synchronism with the advancing of the object 2 in the machine 1, a first presence detector is provided which controls the starting of the motor 17 when an object starts to be inserted into the machine 1, and a second presence detector which triggers the printing process when the object has reached a predetermined location.

Numerous variants are possible depending on circumstances, especially in the composition of the printing means and in those of the drive means which serve to move the object to be franked.

It is reiterated, more generally, that the invention is not limited to the examples described and represented.

What is claimed is:

1. Device for printing a sign at a predetermined location (3) on one face (4) of a flat object (2) having a thickness lying within a given range, including an abutment element (35) for the face (4) of the flat object (2) to be printed, drive means for moving the flat object (2) along the abutment element (35) with its face (4) to be printed which is flush with this element, and printing means (32) including means for depositing the sign at the predetermined location (3) while the flat object (2) is moved by the drive means along the abutment element (35), the drive means including a non-suspended support means (9) for the face (4) of the flat object (2) to be printed, and including a belt (10) featuring a stretch facing the support means (9) and extending between an upstream roller (19) and a downstream roller (22) which are suspended in such a way that permits the flat object (2) to be sandwiched between the non-suspended support means (9) and the stretch of the belt (10); characterized in that the belt (10) is wound around at least two other rollers (18, 20, 21), at least one of which (18, 21) is not suspended.

2. Device according to claim 1, characterized in that at least one of the rollers (18–22) around which the said belt (10) is wound is driven in rotation.

3. Device according to claim 2, characterized in that it is the said other, non-suspended roller (21) which is driven in rotation.

4. Device according to claim 1, further comprising an arm (23, 25) carrying a journal of one of the suspended upstream rollers (19) or the suspended downstream roller (22) while the arm (23, 25) is mounted so as to oscillate on a journal of the other non-suspended roller (18, 21).

5. Device according to claim 4, characterized in that the arm (23, 25) extends downstream from the journal on which the arm is mounted so as to oscillate.

6. Device according to claim 1, characterized in that each of the said other two rollers (18, 21) is not suspended and in that each of the said upstream roller (19) and downstream roller (22) is carried by a respective arm (23, 25) mounted so that it can oscillate on the journal of a respective one of the said other two rollers (18, 21).

7. Device according to claim 1, characterized in that the belt (10) is wound around three of said other rollers, respectively, said three other rollers including a first non-suspended roller (18), a second non-suspended roller (21) and a third suspended roller (20).

8. Device according to claim 7, characterized in that the third suspended roller (20) is suspended dependently from either the upstream roller or the (18) downstream roller (22), such that, if a dependent roller has a suspension movement of such a nature as to slacken the belt (10), the suspension movement of the third roller (20) is of such a nature as to retension the belt (10).

9. Device according to claim 8, characterized in that the said third roller (20) is suspended dependently from the said downstream roller (22).

10. Device according to claim 1, further comprising an arm (25) mounted so that the arm can oscillate at the arm's center on a journal of the other non-suspended roller (21), the arm carrying, at one end, the journal of one of the suspended rollers (22), while at the other end it carries the journal of another suspended roller (20).

11. Device according to claim 1, characterized in that the said upstream roller (19) is suspended independently of the said downstream roller (22).

12. Device according to claim 1, characterized in that the said non-suspended support means is formed by the stretch of a second belt (9) extending between two non-suspended rollers (13, 14) positioned in a predetermined way with respect to the said abutment element (35).

13. Device according to claim 12, characterized in that the said second belt is wound exclusively around non-suspended rollers.

14. Device according to claim 13, characterized in that two of the said non-suspended rollers (13, 16) around which the said second belt is wound serve as a counter-roller respectively for the said upstream roller (19) and for the said downstream roller (22).

15. Device according to claim 12, characterized in that two of the said non-suspended rollers (13, 16) around which the said second belt is wound serve as a counter-roller respectively for the said upstream roller (19) and for the said downstream roller (22).

16. Device according to claim 12, further comprising a motor (17) that serves to drive both the belt (10) and the second belt (9).

17. Device according to claim 1, characterized in that the said abutment element (35) is offset laterally with respect to the said support means (9).

18. Device according to claim 17, characterized in that the said abutment element (35) is arranged between the support means (9) and a lateral abutment means (8) for the flat object (2).

19. Device according to claim 1, characterized in that the said printing means (32) include at least one ink jet cartridge (33) equipped with a head (34) for sending ink onto the said predetermined location of the object, from a recess (36) in the abutment element (35).

20. Franking machine for printing a franking mark, comprising:

a device for printing the franking mark at a predetermined location (3) on one face (4) of a flat object (2) having a thickness lying within a given range, including an abutment element (35) for the face (4) of the flat object (2) to be printed, drive means for moving the object (2) along the abutment element (35) with its face (4) to be printed which is flush with this element, and printing means (32) including means for depositing the franking mark at the predetermined location (3) while the object (2) is moved by the drive means along the abutment element (35), the drive means including a non-suspended support means (9) for the face (4) of the object (2) to be printed, and including a belt (10) featuring a stretch facing the support means (9) and extending between an upstream roller (19) and a downstream roller (22) which are suspended in such a way that permits the object (2) to be sandwiched between the non-suspended support means (9) and the stretch of the belt (10); characterized in that the belt (10) is wound around at least two other rollers (18, 20, 21), at least one of which (18, 21) is not suspended.

* * * * *